US006609265B1

(12) United States Patent
Jee

(10) Patent No.: US 6,609,265 B1
(45) Date of Patent: Aug. 26, 2003

(54) SEISMIC PROOF ARTICULATING BRIDGE DECK EXPANSION JOINT

(76) Inventor: Thomas C. Jee, 2359 15$^{th}$ Ave., San Francisco, CA (US) 94116

( * ) Notice: Subject to any disclaimer, the term of this patent is extended or adjusted under 35 U.S.C. 154(b) by 0 days.

(21) Appl. No.: 10/264,694

(22) Filed: Oct. 3, 2002

(51) Int. Cl.$^{7}$ ..... E01D 19/06; E01D 19/04
(52) U.S. Cl. ..... 14/73.1; 14/73.5; 52/393
(58) Field of Search ..... 14/73.1, 73.5; 52/393, 395

(56) References Cited

U.S. PATENT DOCUMENTS

| | | | | | |
|---|---|---|---|---|---|
| 3,604,322 | A | * | 9/1971 | Koster | 404/53 |
| 3,797,952 | A | * | 3/1974 | Pommerening et al. | 404/52 |
| 4,120,066 | A | | 10/1978 | Leroux | 14/16.5 |
| 4,516,284 | A | | 5/1985 | Huber et al. | 14/16.5 |
| 4,557,082 | A | * | 12/1985 | Dunsworth | 52/109 |
| 4,566,143 | A | * | 1/1986 | Honegger et al. | 14/73.1 |
| 4,616,954 | A | * | 10/1986 | Taga | 404/74 |
| 4,674,912 | A | * | 6/1987 | Buckenauer | 404/56 |
| 5,172,533 | A | * | 12/1992 | Face, Jr. | 52/396.04 |
| 5,302,050 | A | | 4/1994 | Buckenauer et al. | 404/53 |
| 5,887,308 | A | | 3/1999 | Walter | 14/73.1 |
| 6,022,169 | A | | 2/2000 | Kim et al. | 404/52 |
| 6,460,214 | B1 | * | 10/2002 | Chang | 14/73.1 |
| 6,527,467 | B2 | * | 3/2003 | Betts | 403/122 |

FOREIGN PATENT DOCUMENTS

| | | | |
|---|---|---|---|
| JP | 2001-3462 | * | 1/2003 |

* cited by examiner

*Primary Examiner*—Gary S. Hartmann
(74) *Attorney, Agent, or Firm*—Patent Law Group LLP; David C. Hsia

(57) ABSTRACT

A bridge expansion joint assembly includes at least a first expansion module and a second expansion module on opposing bridge structures. The first expansion module includes a first hinge pivotally mounted to a first bridge structure so the first hinge can rotate about a first axis, and a first group of fingers pivotally mounted to the first hinge so the first group of fingers can rotate about a second axis. The second expansion module includes a second hinge pivotally mounted to a second bridge structure so the second hinge can rotate about a third axis, and a second group of fingers mounted, either fixedly or pivotally, to the second hinge. The first group of fingers and the second group of fingers are interdigitated and rest upon a sliding support.

9 Claims, 5 Drawing Sheets

SEISMIC PROOF ARTICULATING BRIDGE DECK EXPANSION JOINT

FIELD OF INVENTION

This invention relates to expansion joints for bridges and other structures. DESCRIPTION OF RELATED ART FIGS. 1A and 1 B respectively illustrate plan and elevation views of a conventional bridge 100. Bridge 100 consists of a main span 102 suspended by cables 104 between main towers 106 and 108. A side span 114 is suspended by cables 104 between main tower 106 and pier 116 while side span 118 is suspended by cables 104 between main tower 108 and pier 120.

Main span 102 is connected to main towers 106 and 108 by expansion joint assemblies 126 and 128, respectively. Side span 114 is connected to main tower 106 and pier 116 by expansion joint assemblies 130 and 132, respectively. Side span 118 is connected to main tower 108 and pier 120 by joint assemblies 134 and 136.

FIGS. 2A and 2B illustrate partial plan and elevation views of a bridge expansion joint assembly 200 that can be used for the expansion joint assemblies of bridge 100. Expansion joint assembly 200 includes an expansion joint 202 attached to a bridge superstructure (e.g., a deck on main tower 106) and an expansion joint 204 attached to another bridge superstructure (e.g., a deck on main span 102). Fingers 206 of expansion joint 202 are interdigitated with fingers 208 of expansion joint 204 over a sliding support 210 to accommodate relative motion along the longitudinal direction between main tower 106 and main span 102. Expansion joint assembly 200 allows bridge 100 to expand and contract with temperature changes.

Expansion joint assembly 200 does not accommodate vertical or transverse movement. Thus, expansion joint assembly 200 is ill suited for bridges in areas that have large magnitude earthquakes. Accordingly, what is needed is a multidirectional bridge deck expansion joint that will accommodate longitudinal, vertical, and transverse movement demands for new bridges and for seismic retrofitting of existing bridges to prevent serious bridge deck damage and possible loss of life resulting from large magnitude earthquakes.

SUMMARY OF THE INVENTION

In one embodiment of the invention, an expansion joint assembly includes a first expansion module and a second expansion module on opposing structures. The first expansion module includes a first hinge pivotally mounted to a first structure so the first hinge can rotate about a first axis, and a first group of fingers pivotally mounted to the first hinge so the first group of fingers can rotate about a second axis. The second expansion module includes a second hinge pivotally mounted to a second structure so the second hinge can rotate about a third axis, and a second group of fingers mounted, either fixedly or pivotally, to the second hinge. The first group of fingers and the second group of fingers are interdigitated and rest upon a sliding support.

DETAILED DESCRIPTION

A multidirectional bridge expansion joint assembly is composed of a series of cantilevered plates bolted to the bridge deck superstructure by hinges. These plates are divided into groups of two or three to create individual modules that can be easily installed. The plate dimensions may be adjusted to any size to accommodate any longitudinal movement required by service or seismic loads. The hinge at each module connection allows the expansion joint assembly the ability to accommodate any transverse and vertical movement.

Figure 1A:
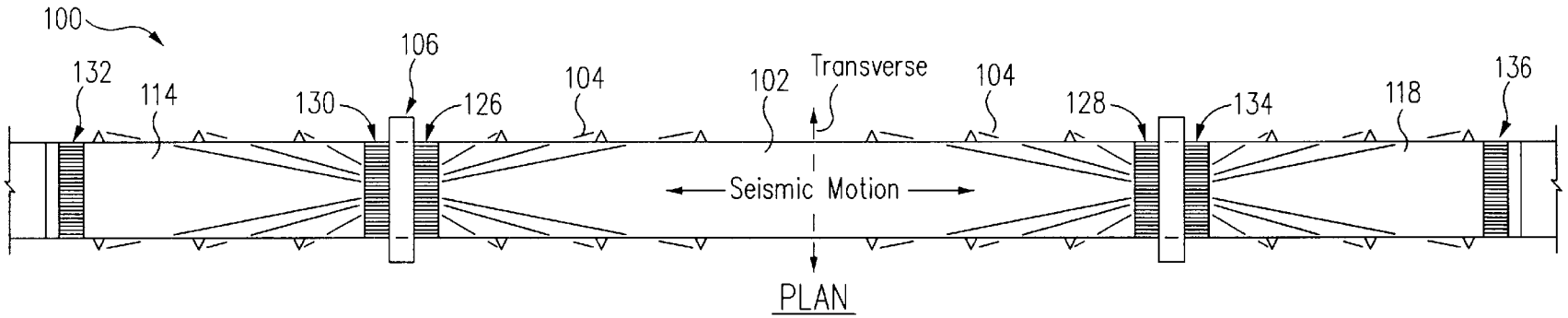
FIG. 1A (Prior Art)
FIGS. 1A and 1B respectively illustrate plan and elevation views of a conventional bridge.
Figure 1B:
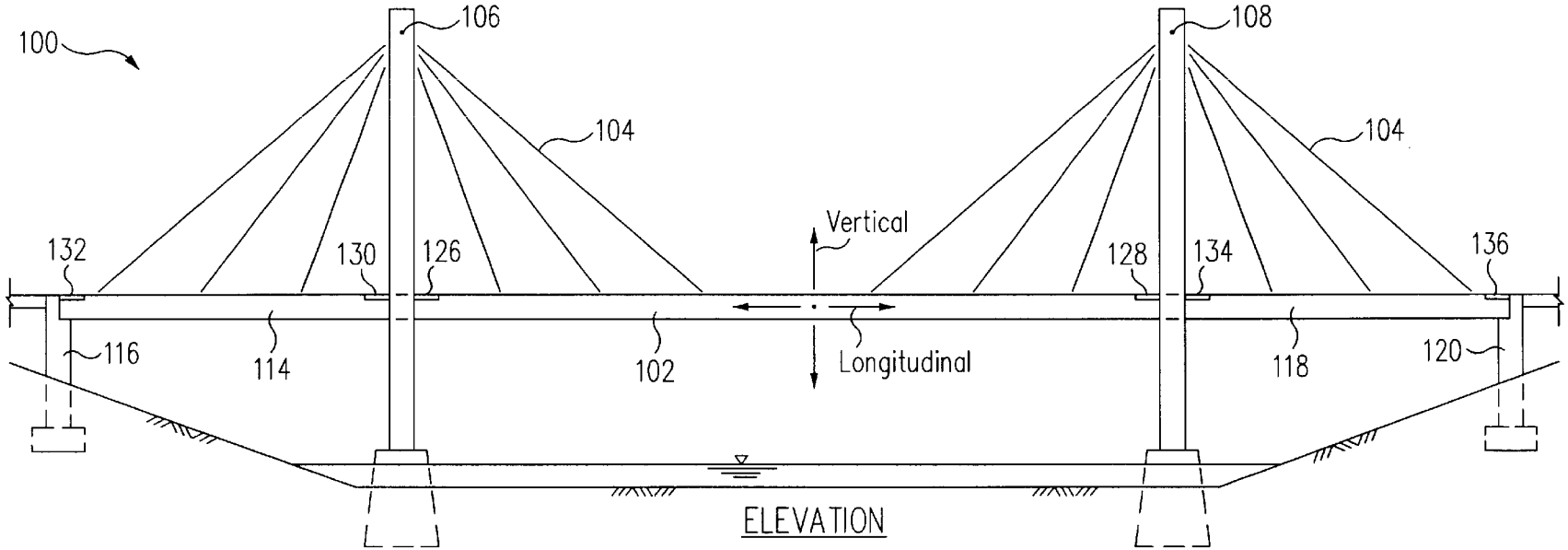
FIG. 1B (Prior Art)
Figure 2A:
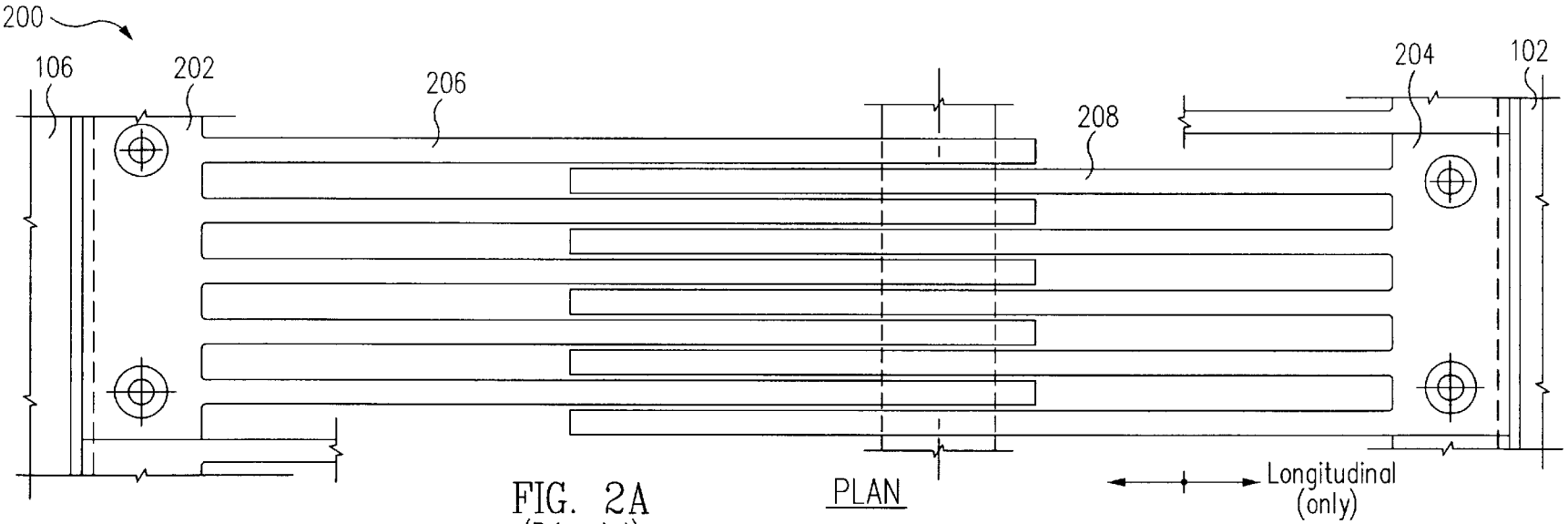
FIG. 2A (Prior Art)
FIGS. 2A and 2B respectively illustrate partial plan and elevation views of a conventional bridge expansion joint assembly.
Figure 2B:
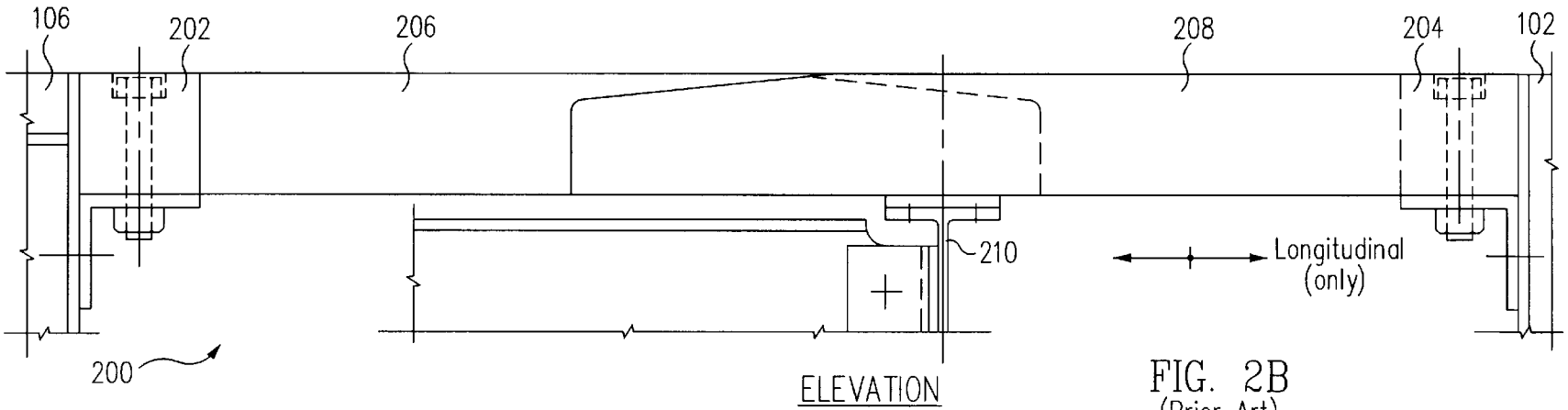
FIG. 2B (Prior Art)
Figure 3A:
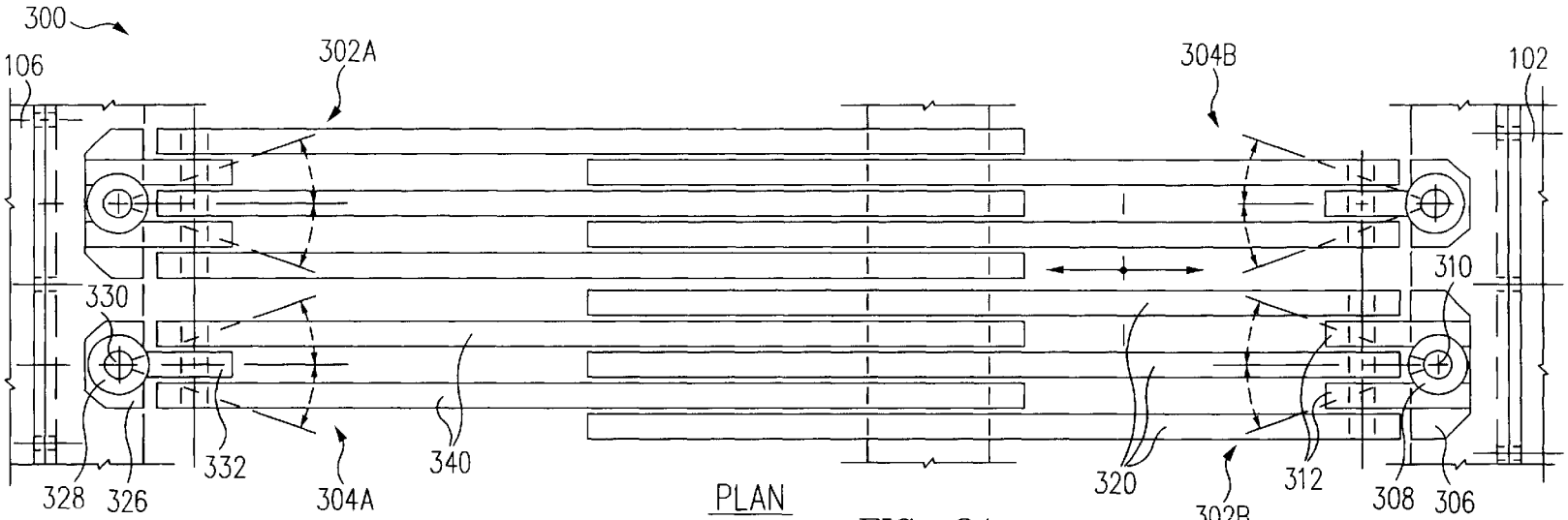
FIGS. 3A and 3B respectively illustrate partial plan and elevation views of a multidirectional bridge expansion joint assembly in an undisturbed state in one embodiment of the invention.
Figure 3B:
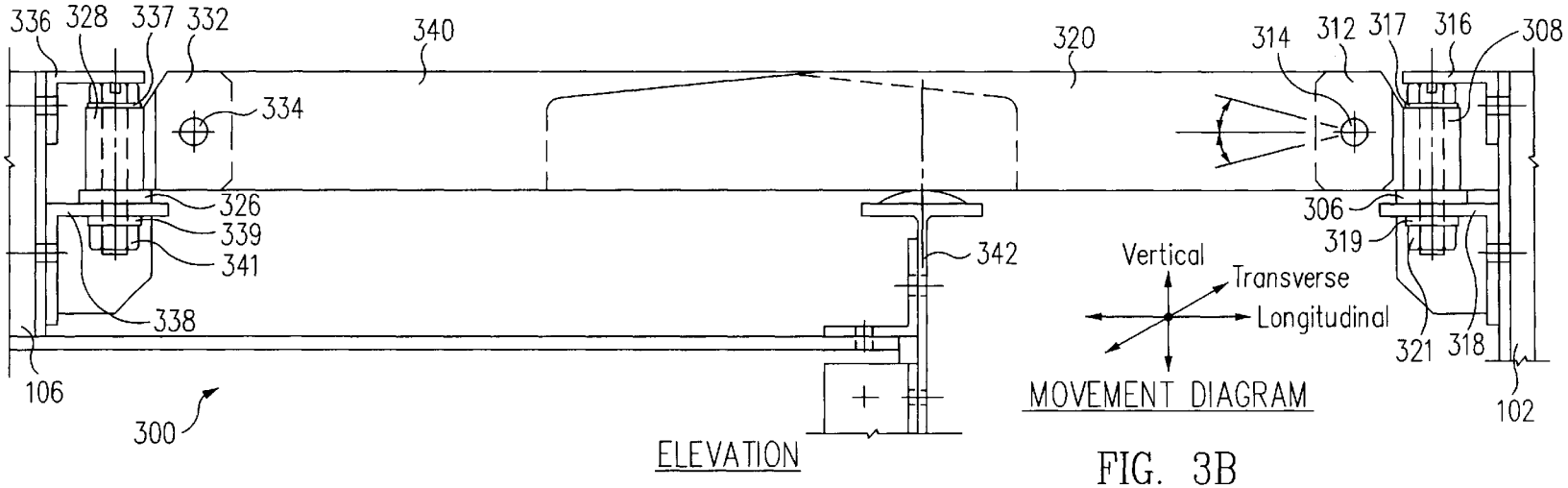

FIGS. 3A and 3B respectively illustrate partial plan and elevation views of a multidirectional bridge expansion joint assembly 300 in an undisturbed state in one embodiment of the invention. Expansion joint assembly 300 can be used for the expansion joint assemblies of bridge 100 or similar structures.

Expansion joint assembly 300 includes expansion modules 302A and 304A attached to a bridge superstructure (e.g., a roadway deck on main tower 106), and expansion modules 302B and 304B attached to an opposing bridge superstructure (e.g., a roadway deck on main span 102). Expansion modules 302A, 304A, 302B, and 304B connect the decks on main tower 106 and main span 102. Although only four expansion modules are exemplarily shown, the actual number of expansion modules is varied to match the deck width of bridge 100.

Expansion module 302B includes a hinge 306 with a knuckle 308 having a vertical bore to receive a vertical bolt 310 (FIG. 3A), and two knuckles 312 having horizontal bores to receive a horizontal pin 314 (FIG. 3B). Hinge 306 is pivotally mounted between a top bracket 316 and a bottom bracket 318 by vertical bolt 310. Vertical bolt 310 is secured in place with nut 321. Washer 317 is situated below the head of vertical bolt 310. Washer 319 is situated above nut 321. Top bracket 316 and bottom bracket 318 are mounted to main span 102. Thus, hinge 306 can pivot about a vertical axis.

Expansion module 302B further includes three plates 320 (commonly called "fingers") having horizontal bores to receive horizontal pin 314. Fingers 320 are pivotally mounted to knuckles 312 of hinge 306 by horizontal pin 314. Thus, fingers 320 can pivot about a horizontal axis.

Expansion module 302A is constructed like expansion module 302B.

Expansion module 304A is similarly constructed like expansion module 302B except for the number of fingers pivotally mounted to the hinge. Expansion module 304A includes a hinge 326 with a knuckle 328 having a vertical bore to receive a vertical bolt 330 and a knuckle 332 having a horizontal bore to receive a horizontal pin 334. Hinge 326 is pivotally mounted between a top bracket 336 and a bottom bracket 338 by vertical bolt 330. Vertical bolt 330 is secured in place with nut 341. Washer 337 is situated below the head of vertical bolt 330. Washer 339 is situated above nut 341. Top bracket 336 and bottom bracket 338 are mounted to main tower 106. Thus, hinge 326 can pivot about a vertical axis.

Expansion module 304A further includes two fingers 340 having horizontal bores to receive horizontal pin 334. Fingers 340 are pivotally mounted to knuckle 332 of hinge 326 by horizontal pin 334. Thus, fingers 340 can pivot about a horizontal axis.

Expansion module 304B is constructed like expansion module 304A.

The fingers of expansion modules 302A and 304A are interdigitated with the fingers of expansion modules 302B and 304B over a sliding support 342 to accommodate-relative motion between main tower 106 and main span 102 along multiple axes.

Figure 4A:
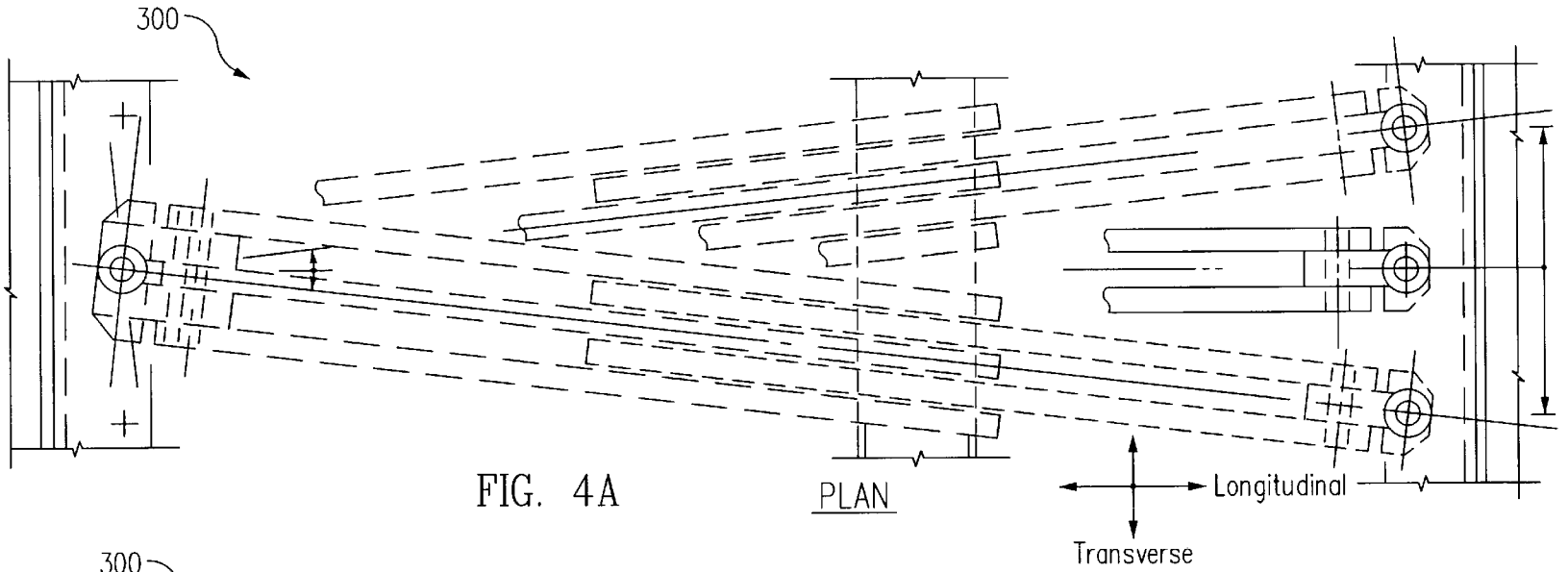
FIGS. 4A and 4B respectively illustrate partial plan and elevation views of the multidirectional bridge expansion joint assembly in a disturbed state in one embodiment of the invention.
Figure 4B:
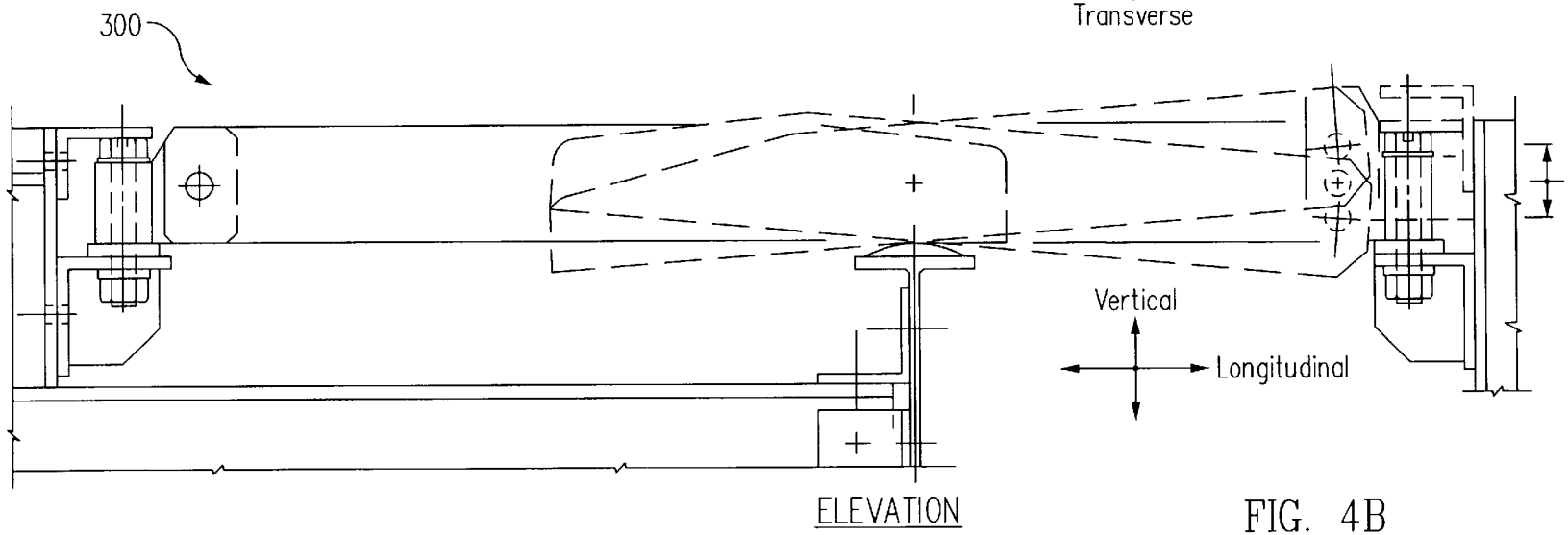

FIGS. 4A and 4B illustrate partial plan and elevation views of expansion joint assembly 300 in disturbed states in one embodiment of the invention. As in a conventional finger expansion joint, the interdigitated fingers of expansion joint assembly 300 accommodate longitudinal motion between bridge superstructures. In addition, the hinges of expansion joint assembly 300 accommodate vertical and transverse motion between bridge superstructures. As shown in FIG. 4A, the hinges can rotate left and right from their pivot about the bridge superstructure to accommodate transverse movements. As shown in FIG. 4B, the fingers can rotate up and down from their pivot about the hinges to accommodate vertical movements.

Expansion joint assembly 300 prevents serious damage to bridge superstructure during a large magnitude earthquake caused by inadequate deck expansion joint system. By preventing serious damage, expansion joint assembly 300 allows bridge to remain open immediately after an earthquake to allow for emergency vehicle access. Expansion joint assembly 300 has a simple elegant design for easy installation and minimal long-term maintenance while accommodating any amount of thermal displacement.

Figure 5A:
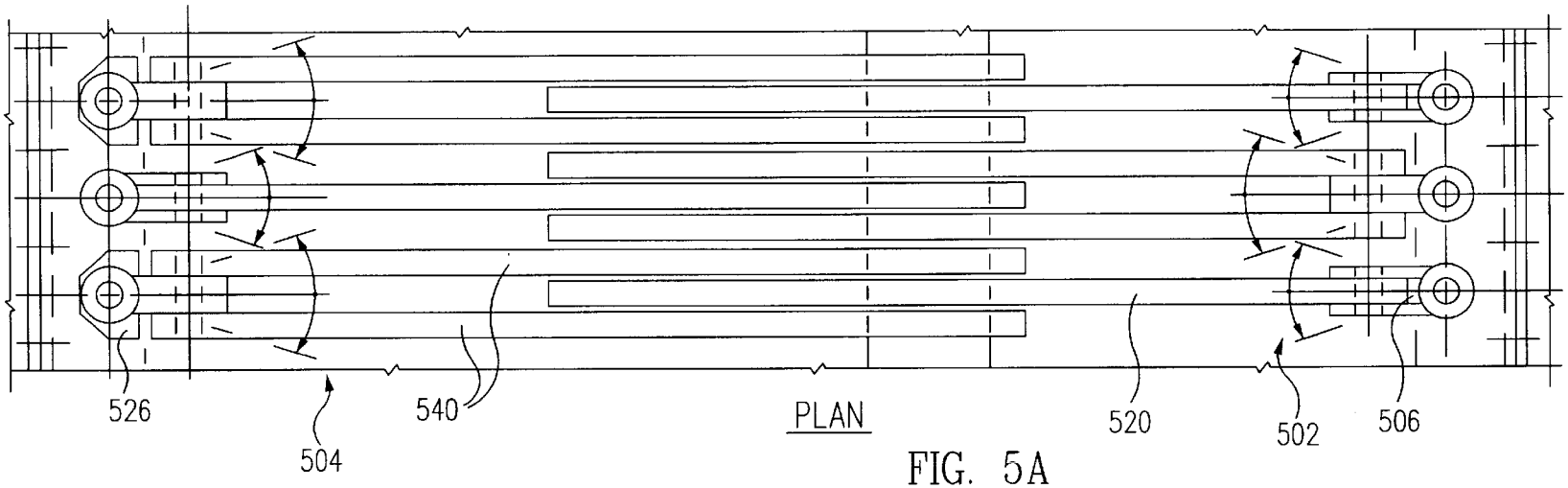
FIGS. 5A and 5B respectively illustrate partial plan and elevation views of a multidirectional bridge expansion joint assembly in an undisturbed state in another embodiment of the invention.
Figure 5B:
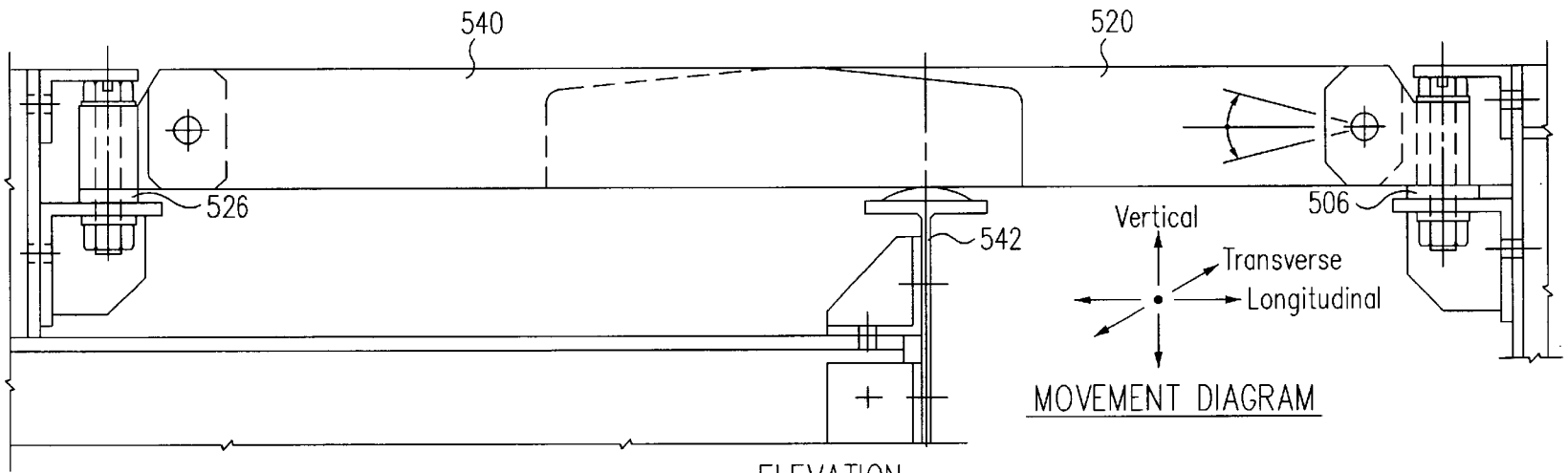

FIGS. 5A and 5B respectively illustrate partial plan and elevation views of a multidirectional bridge expansion joint assembly 500 in another embodiment of the invention. Expansion joint assembly 500 is different from expansion joint assembly 300 only in the number of fingers attached to the hinges. Specifically, expansion joint module 502 includes one finger 520 pivotally mounted to a hinge 506 while expansion joint module 504 includes two fingers 540 pivotally mounted to a hinge 526. Fingers 520 and 540 are interdigitated and rest upon sliding support 542. Expansion joint modules 502 and 504 can be used to adjust more precisely the width of an expansion joint across the roadway decks when other expansion joint modules are too large. As can be seen, the number of fingers attached to the hinges can be adjusted to achieve the desired width of the expansion joint.

Various other adaptations and combinations of features of the embodiments disclosed are within the scope of the invention. For example, if an expansion module and a sliding support are mounted to the same bridge superstructure, the fingers of the expansion module can be fixedly attached to the horizontal hinge, eliminating the vertical hinge, because there will be little or no relative vertical motion between the sliding support and the fingers of the expansion module. The expansion module mounted to the opposing bridge superstructure will remain unchanged because there will still be relative longitudinal, transverse, and vertical motion with the other bridge superstructure. Furthermore, the expansion joint assembly can be applied to other structures in addition to bridges. Numerous embodiments are encompassed by the following claims.

what is claimed is:

1. An expansion joint assembly, comprising:

a first hinge pivotally mounted to a first structure, the first hinge being free to rotate about a first vertical axis;

a first plurality of fingers pivotally mounted to the first hinge, the first plurality of fingers being free to rotate about a horizontal axis;

a second hinge pivotally mounted to a second structure, the second hinge being free to rotate about a second vertical axis;

a second plurality of fingers mounted to the second hinge;

wherein the first plurality of fingers and the second plurality of fingers are interdigitated and rest upon a sliding support.

2. The expansion joint assembly of claim 1, wherein the second plurality of fingers are fixedly mounted to the second hinge and the sliding support is fixedly mounted to the second structure.

3. The expansion joint assembly of claim 1, wherein the second plurality of fingers are pivotally mounted to the second hinge, the second plurality of fingers being free to rotate about a second horizontal axis.

4. The expansion joint assembly of claim 1, wherein the first and the second structures form part of a bridge.

5. An expansion joint assembly, comprising:

a first hinge pivotally mounted to a first structure, the first hinge being, free to rotate about a first vertical axis;

at least a first finger pivotally mounted to the first hinge, the first finger being free to rotate about a horizontal axis;

a second hinge pivotally mounted to a second structure, the second hinge being free to rotate about a second vertical axis;

a plurality of second fingers mounted the second hinge; 4 wherein the first finger and the second fingers are interdigitated and rest upon a sliding support adjacent to each other.

6. The expansion joint assembly of claim 5, wherein the second fingers are pivotally mounted to the second hinge, the second fingers being free to rotate about a second horizontal axis.

7. The expansion joint assembly of claims 5, wherein the second fingers are fixedly mounted to the second hinge and the sliding support is fixedly mounted to the second structure.

8. The expansion joint assembly of claim 5, wherein the first and the second structures form part of a bridge.

9. A bridge expansion joint assembly, comprising:

a first hinge pivotally mounted to a first bridge structure, the first hinge being free to rotate about a first vertical axis;

a first plurality of fingers pivotally mounted to the first hinge, the first plurality of fingers being free to rotate about a first horizontal axis;

a second hinge pivotally mounted to a second bridge structure, the second hinge being free to rotate about a second vertical axis;

a second plurality of fingers mounted to the second hinge;

a second plurality of fingers pivotally mounted to the second hinge, the second plurality of fingers being free to rotate about a second horizontal axis;

wherein the first plurality of fingers and the second plurality of fingers are interdigitated and rest upon a sliding support.

* * * * *